US007690138B2

(12) United States Patent
Hall et al.

(10) Patent No.: US 7,690,138 B2
(45) Date of Patent: Apr. 6, 2010

(54) ROLLING ASSEMBLY MOUNTED ON A TRENCHER

(76) Inventors: David R. Hall, 2185 S. Larsen Pkwy., Provo, UT (US) 84606; Francis Leany, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 121 days.

(21) Appl. No.: 11/748,184

(22) Filed: May 14, 2007

(65) Prior Publication Data

US 2008/0282584 A1 Nov. 20, 2008

(51) Int. Cl.
*E02F 9/28* (2006.01)

(52) U.S. Cl. ..... 37/460; 175/371

(58) Field of Classification Search ..... 37/94, 37/189, 190, 337, 452, 462, 460; 299/85.1, 299/79.1, 77, 78, 110, 73, 96–89; 175/81, 175/94, 355, 122, 364, 373
See application file for complete search history.

(56) References Cited

U.S. PATENT DOCUMENTS 3,787,101 A * 1/1974 Sugden ..... 384/481
4,035,024 A * 7/1977 Fink ..... 299/31
4,548,442 A * 10/1985 Sugden et al. ..... 299/10
5,074,063 A 12/1991 Vannette
5,219,380 A 6/1993 Young et al.
5,295,735 A * 3/1994 Cobbs et al. ..... 299/110
5,392,540 A 2/1995 Cooper et al.
RE35,088 E 11/1995 Gilbert
5,484,191 A * 1/1996 Sollami ..... 299/105
5,490,339 A 2/1996 Accettola
5,785,135 A * 7/1998 Crawley ..... 175/373
5,791,825 A * 8/1998 Gardner et al. ..... 405/267
6,085,446 A * 7/2000 Posch ..... 37/343
6,341,823 B1 1/2002 Sollami
6,367,569 B1 * 4/2002 Walk ..... 175/373
6,457,267 B1 10/2002 Porter et al.
6,543,963 B2 4/2003 Bruso
6,779,948 B2 8/2004 Bruso
6,854,201 B1 2/2005 Hunter et al.
6,944,977 B2 * 9/2005 Deniau et al. ..... 37/94
7,150,131 B2 12/2006 Barker

* cited by examiner

*Primary Examiner*—Robert E Pezzuto
(74) *Attorney, Agent, or Firm*—Tyson J. Wilde; Derek Battisti; Philip W. Townsend, III

(57) ABSTRACT

In one aspect of the invention a trenching machine for degrading natural and man-made formations, comprising a plurality of roller assemblies exteriorly mounted to a trenching boom or wheel. The rollers comprising a plurality of pointed inserts radially arranged along the wheel's outer diameter. The inserts are adapted to degrade the formation when the boom or wheel is activated.

16 Claims, 9 Drawing Sheets

ROLLING ASSEMBLY MOUNTED ON A TRENCHER

BACKGROUND OF THE INVENTION

In the trenching industry, earth may be degraded using picks or teeth to break up minerals and rocks. Picks are generally attached to trenching booms or wheels and are used for making trenches in the earth for installing pipes and utility lines and digging foundations for homes or other buildings.

Some of the trenching machines of the prior art are disclosed in U.S. Pat. Nos. 7,150,131; 6,854,201; 6,457,267, and 6,341,823.

BRIEF SUMMARY OF THE INVENTION

In one aspect of the invention a trenching machine for degrading natural and man-made formations has a plurality of picks with wheels rotationally supported by housings exteriorly mounted to a trenching boom or wheel. The roller assemblies have a plurality of pointed inserts radially arranged along an outer diameter of the wheel. The inserts may have a tip adapted to impact the formation.

The tip of the pointed inserts may comprise a superhard material selected from the group consisting of cubic boron nitride, diamond, diamond like material, or combinations thereof. In some embodiments, the tip comprises a carbide substrate bonded to the superhard material. The superhard material may be at least 0.100 inches thick, and may have a volume of 3 to 20 percent metal binder concentration. The tip may also comprise a 0.05 to 0.20 inch apex radius. The tip may be brazed to a carbide core which is press fit into a pocket formed in the wheel.

The pointed inserts may be radially positioned about the wheel which rotates about an axis causing the pointed inserts to rotationally engage the surface. The rotation of the pointed inserts is believed to lessen the drag that would otherwise occur on the pointed inserts thus, extending the life of the pointed inserts. The rotation effect is also believed to degrade the formation in larger chucks than dragging the tip against the formation. The cores may be press fit into pockets of the wheel. In other embodiments, the cores are brazed to the outer surface of the wheel or they are brazed or otherwise bonded into pockets formed in the wheel. In some embodiments the wheels are made of metal, steel, stainless steel, or hardened steel. In some embodiments of the invention the wheel and housing will be protected with a wear resistant material. Carbide buttons may be attached to the wheel, housing, or other components of the rolling assemblies to prevent wear.

The trenching machine may have a dampening element adapted to vibrationally insulate itself from the chain driven assembly. The dampening element may comprise a shock absorber, an elastic material, or a combination thereof.

In another aspect of the invention, a method comprising the steps of providing a plurality of roller assemblies comprising wheels rotationally supported by housings exteriorly mounted to a trenching boom or wheel. The wheels of the roller assembly comprise a plurality of pointed inserts radially arranged along the wheel's outer diameter. Another step involved positioning the trenching boom or wheel adjacent the formation; and another step involves degrading the formation with the inserts by activating the trenching boom or wheel.

FIG. **6*a*** is a perspective diagram of another embodiment of a roller assembly.

Figure 7:
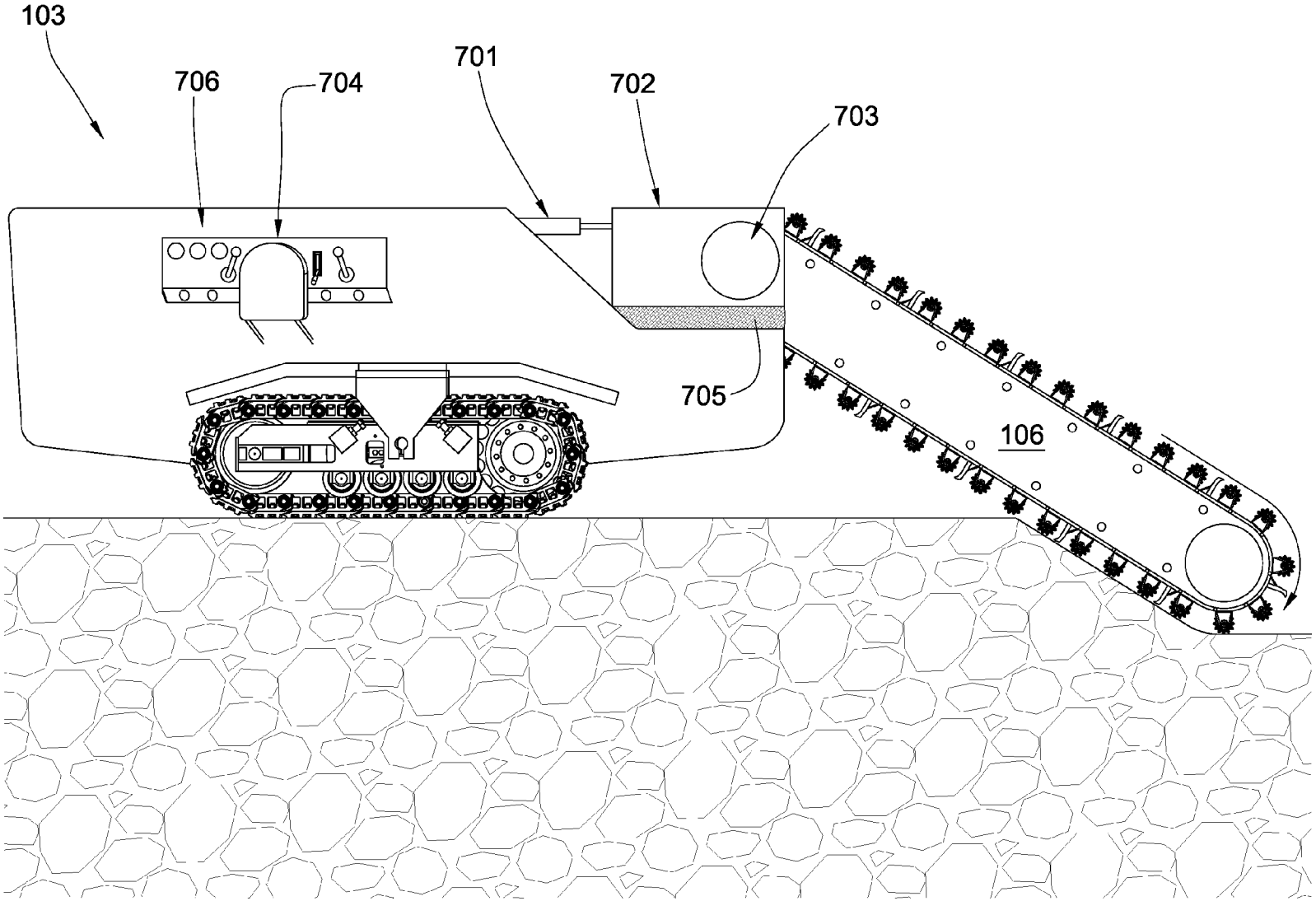

FIG. 7 is an orthogonal diagram of an embodiment of a dampening element.

Figure 8:
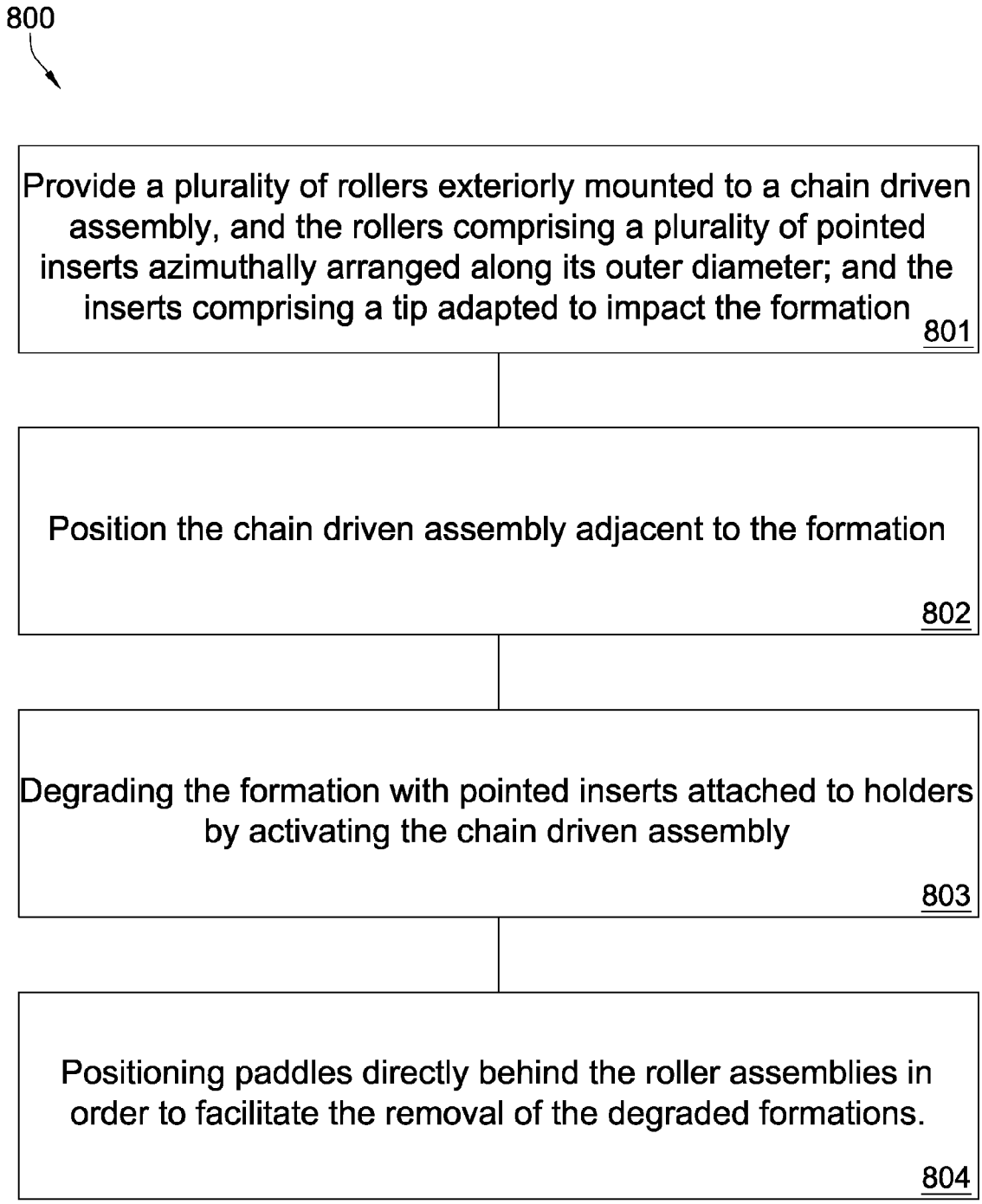

FIG. 8 is a flowchart illustrating an embodiment of a method for degrading natural and manmade formations.

DETAILED DESCRIPTION OF THE INVENTION AND THE PREFERRED EMBODIMENT

Figure 1:
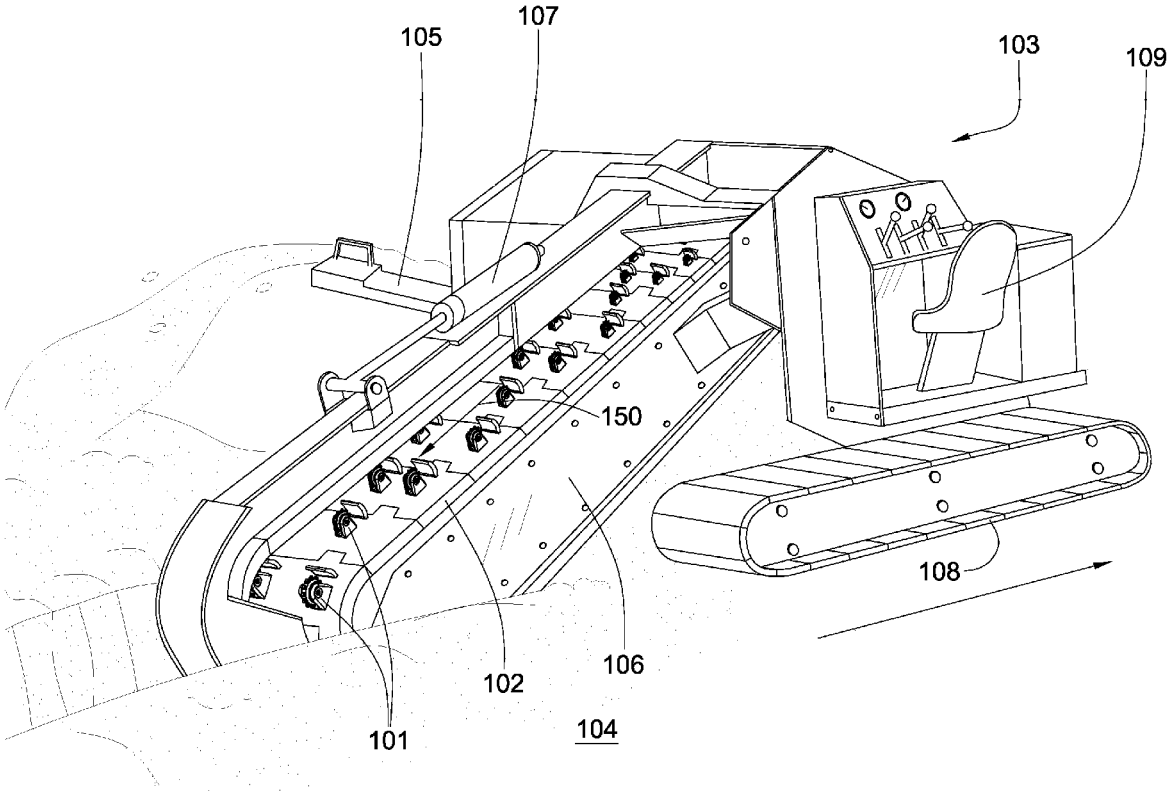
FIG. 1 is a perspective diagram of an embodiment of a plurality of rollers on a rotating chain attached to a motor vehicle.

FIG. 1 is a perspective diagram of an embodiment of a plurality of roller assemblies 101 on a trenching boom 102 attached to a motor vehicle 103. The plurality of roller assemblies 101 is exteriorly mounted in a "V" pattern on the chain 102 of the boom 106 to facilitate degradation and removal of a formation 104. The chain 102 rotates in the direction of the arrow 150 and cuts the formation 104 forming a trench while bringing the formation 104 cuttings out of the trench to a conveyor belt 105 which directs the cuttings to a side of the trench. The boom 102 may be raised while the machine is being transported or it may be lowered for trenching as shown in FIG. 1. The position of the boom 102 may be controlled by a hydraulic piston and cylinder 107. The trenching machine may move about the formation 104 by tracks 108, wheels, or a combination thereof. A seat 109 for an operator is positioned on the side of the machine.

Figure 2:
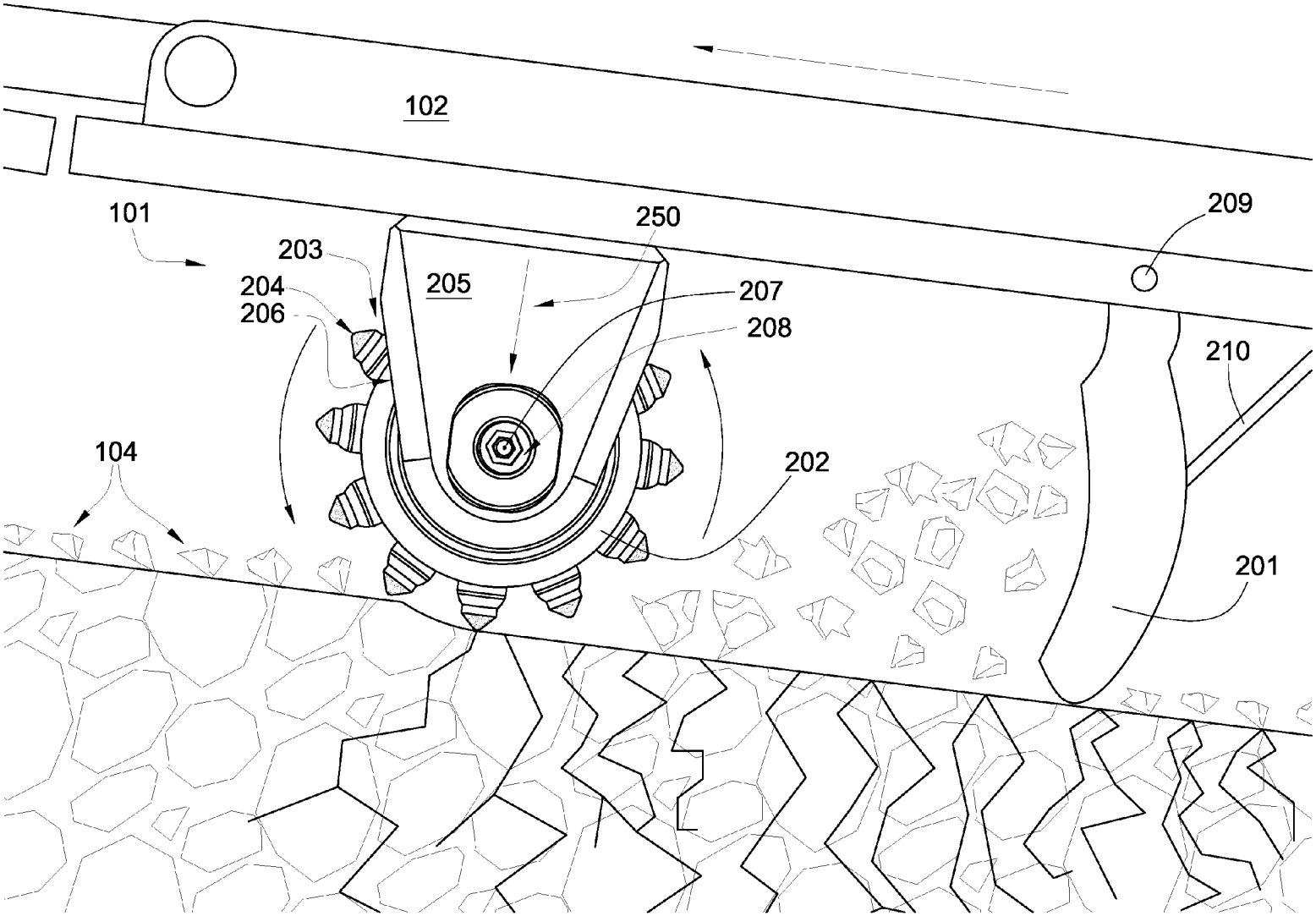
FIG. 2 is a perspective diagram of an embodiment of a roller degrading a formation with a paddle removing the degraded formation.

FIG. 2 is a perspective diagram of an embodiment of a roller assembly 101 degrading a formation 104 along with a paddle 201 positioned behind the roller assembly 101 for removing loose fragments of the formation 104. The roller assembly 101 comprises a wheel 202 with pointed inserts 203 that are radially positioned on the wheel's outer diameter. The pointed inserts 203 further comprise an impact tip 204 adapted to engage the formation 104. The wheel 202 is rotationally support by a housing 205 that is attached to the chain 102. The housing 205 may comprise an internal saddle 206 about which the inserts pass by. The saddle 206 may leave a gap of 1 to 3 inches between it and the wheel 202, and the wheel 202 may have a thickness of 0.8 to 2.8 inches. The wheel 202 may be attached to an axle 207 supported by the housing and secured by a nut.

Force is applied in the direction of the arrow 250 loading the weight of the boom on the pointed inserts 203. The pointed inserts 203 engage the surface at the impact tip 204, which is optimized for the wear life of the pick. Wear life is improved because the rotating motion reduces the effects of drag and wear on the pointed inserts 203. The housing 205, the wheel 202, and the pointed inserts 203 may comprise or be coated by a hard material to prevent wear. Carbide buttons may be attached to the housing, wheel, or other components of the rolling assembly by a press fit or they may be bonded.

The impact tips may comprise a super hard material which may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof. The super hard material may be a polycrystalline structure with an average grain size of 10 to 100 microns. In some embodiment, a hard or superhard material may be applied to the roller assembly 101 and/or a paddle 201 to reduce wear.

A paddle 201 may be positioned behind the roller assembly and be adapted to remove loose fragments generated from the trenching process. In the embodiment of FIG. 2, the paddle is rigidly attached to the chain. The paddle may comprise several different geometries such as generally shovel shape, generally scoop shape, generally flat shape generally rounded shape, or a combination thereof.

Figure 3:
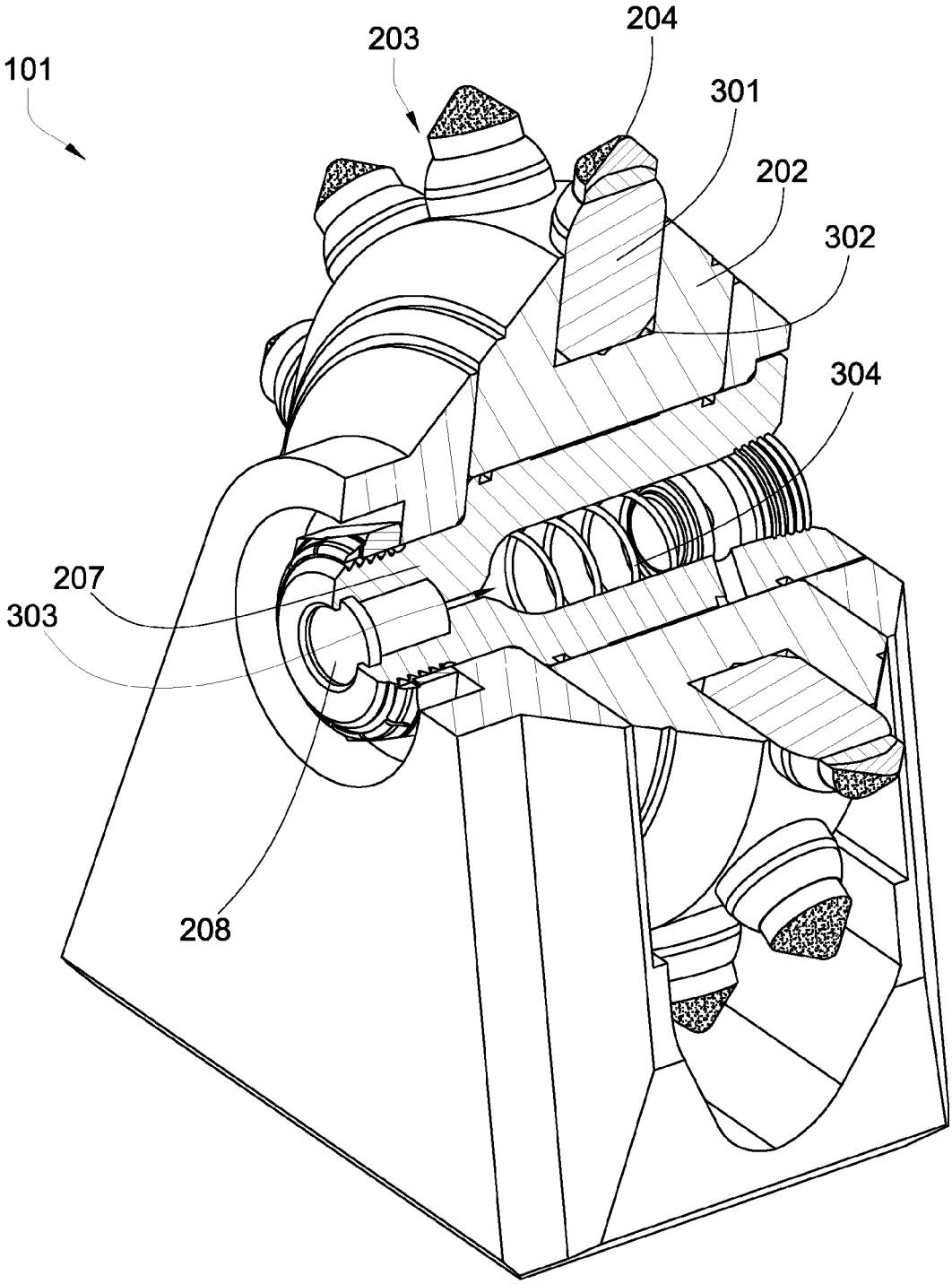
FIG. 3 is a cross-sectional diagram of an embodiment of a roller assembly.

FIG. 3 is a cross-sectional diagram of an embodiment of a roller assembly 101. The roller assembly 101 comprises pointed inserts 203. The pointed inserts 203 comprise a carbide core 301 attached to an impact tip 204 and is press fit into the wheel 202. In other embodiments, the carbide may also be brazed onto the exterior of the wheel 202. The carbide core 301 may comprise a tapered end 302 opposite the impact tip 204. The wheel 202 comprises a central axle 207 about which it rotates. The central axle may comprise an internal accumulator 303. The accumulator 303 may comprise a spring 304, a filter, and a throw-away filter disc, along with an accumulator vent. The accumulator 303 may act as a lubrication system comprising oil or other lubricant. The oil may lubricate the surfaces of the axle and the wheel 202.

Figure 4:
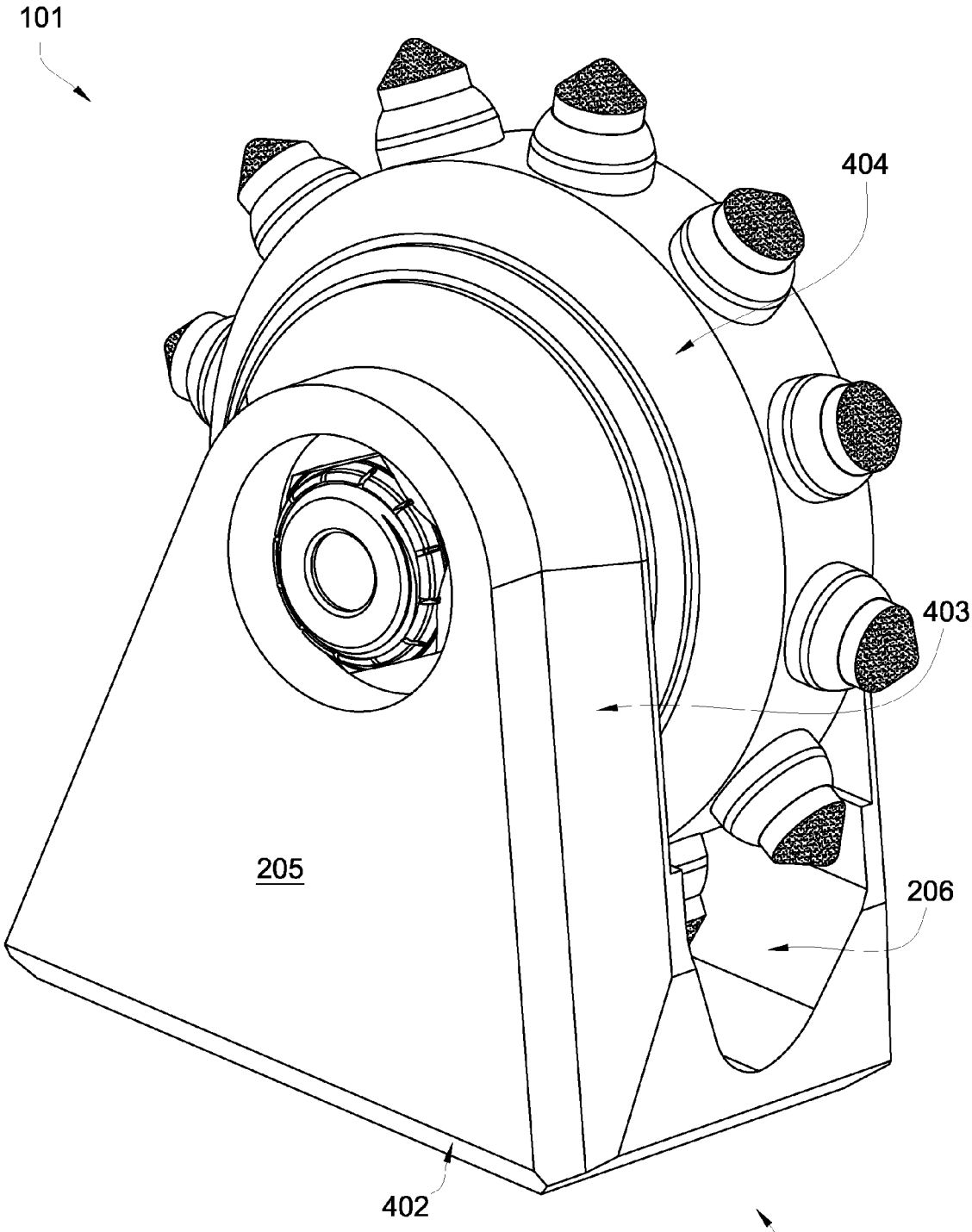
FIG. 4 is a perspective diagram of another embodiment of a roller assembly.

FIG. 4 is a perspective diagram of another embodiment of a roller assembly 101. The roller assembly 101 comprises a housing 205 with a base 401 which comprises a chamfer 402. This chamfer may serve as a weld preparation that allows the caster 205 to be welded to the chain 102. The housing 205 also comprises a taper 403 along the outside of the saddle 206. This taper 403 may reduce wear on the housing 205 and may give the roller assembly 101 a geometry that facilitates the cutting of formations. The wheel 202 comprises an exterior chamfer 404 as well that facilitates the cutting of formations and causes a reduction of wear.

Figure 5:
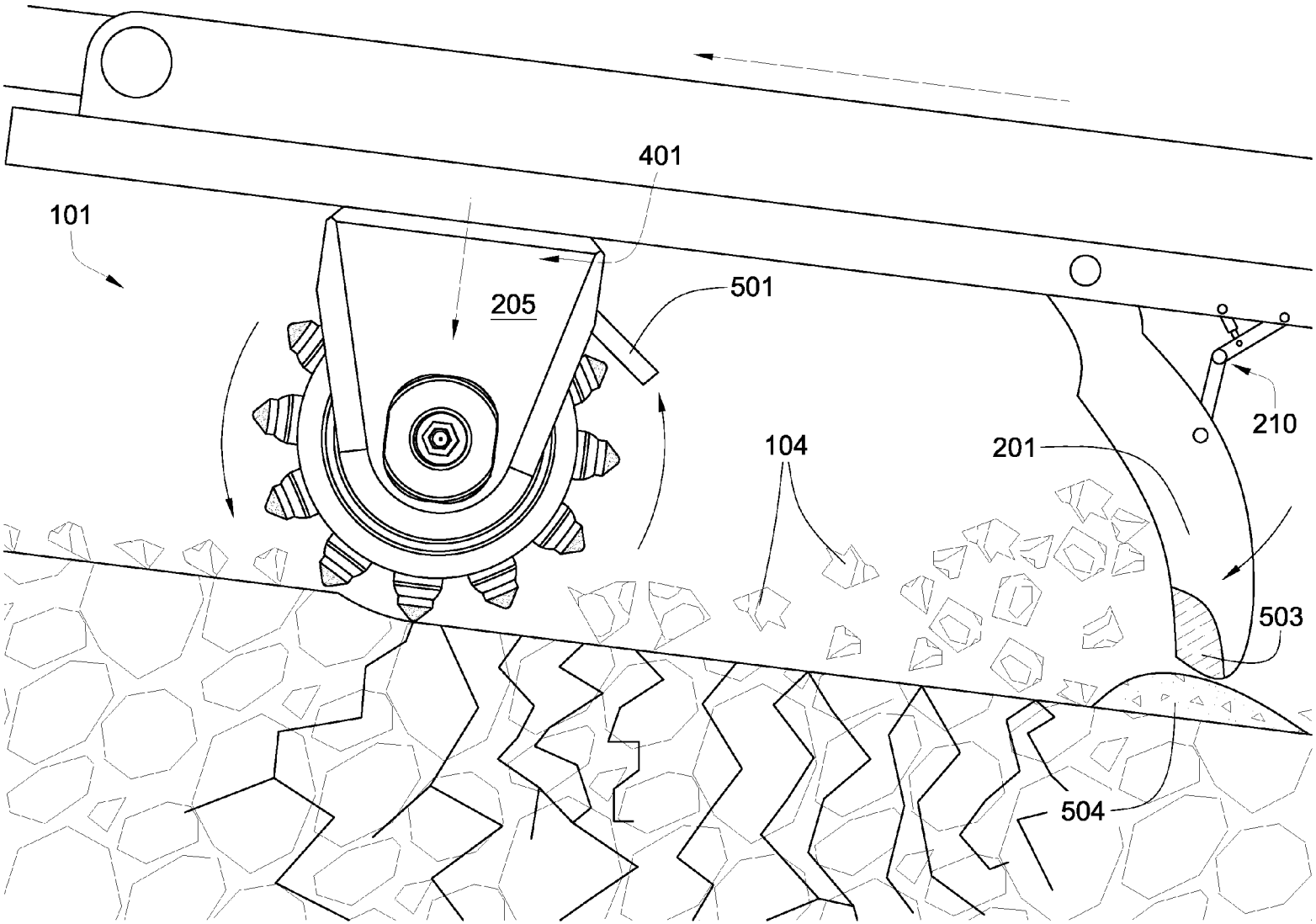
FIG. 5 is a perspective diagram of another embodiment of a roller assembly and a paddle.

FIG. 5 is a perspective diagram of another embodiment of a roller assembly 101 and a paddle 201. The housing 205 comprises a debris guard 501 near the housing base 401. The debris guard 501 may protrude at an angle such that it knocks debris entering the saddle and potentially jamming the wheel 202. In some embodiments, the debris guard may have also a diamond surface bonded to a carbide substrate.

The paddle 201 comprises a wear resistant distal end 503 that runs along the ground. A hard material that may be incorporated in the distal end may be carbide, cubic boron nitride, diamond, diamond like material, or combinations thereof. The paddle is flexibly attached to the chain and is designed to remove the loose unconsolidated portions of the formation while following the profile of the consolidation portions of the formation 104 such as large rocks 504. The paddle 201 comprises a spring mechanism 210 adapted to allow the distal end of the paddle to follow along the profile of the unbroken formation, while pushing the loose cuttings out of the trench. This spring mechanism 210 may comprise a coil spring, a compression spring, a tension spring, Belleville spring, wave spring, elastomeric material, gas spring, or combinations thereof. The spring mechanism may generate an axial load or it may generate an angular load as shown in the embodiment of FIG. 5.

Figure 6:
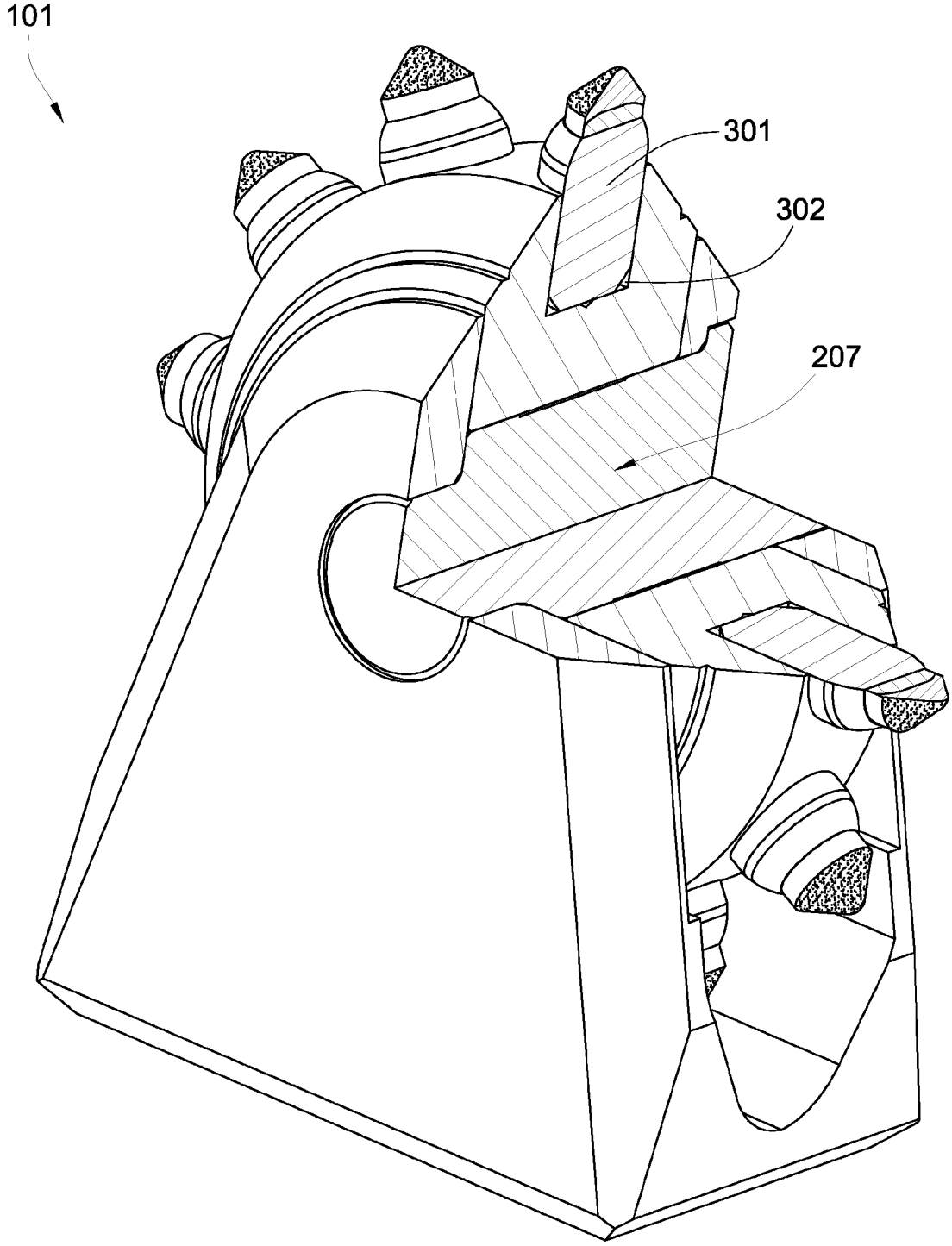
FIG. 6 is a cross-sectional diagram of another embodiment of a roller assembly.

Referring now to FIG. 6, which is a cross-sectional diagram of another embodiment of a roller assembly 101. The pointed inserts 203 comprise a carbide core 301 attached to an impact tip 204 and is press fit into the wheel 202. The carbide may also be brazed onto the exterior of the wheel 202. The carbide core 301 comprises a tapered end 302 opposite the impact tip 204. The wheel 202 comprises a central axle 207 about which it rotates. The central axle 207 may be a solid cylindrical material that allows for low friction and easy rotation for the wheel 202.

Figure 6A:
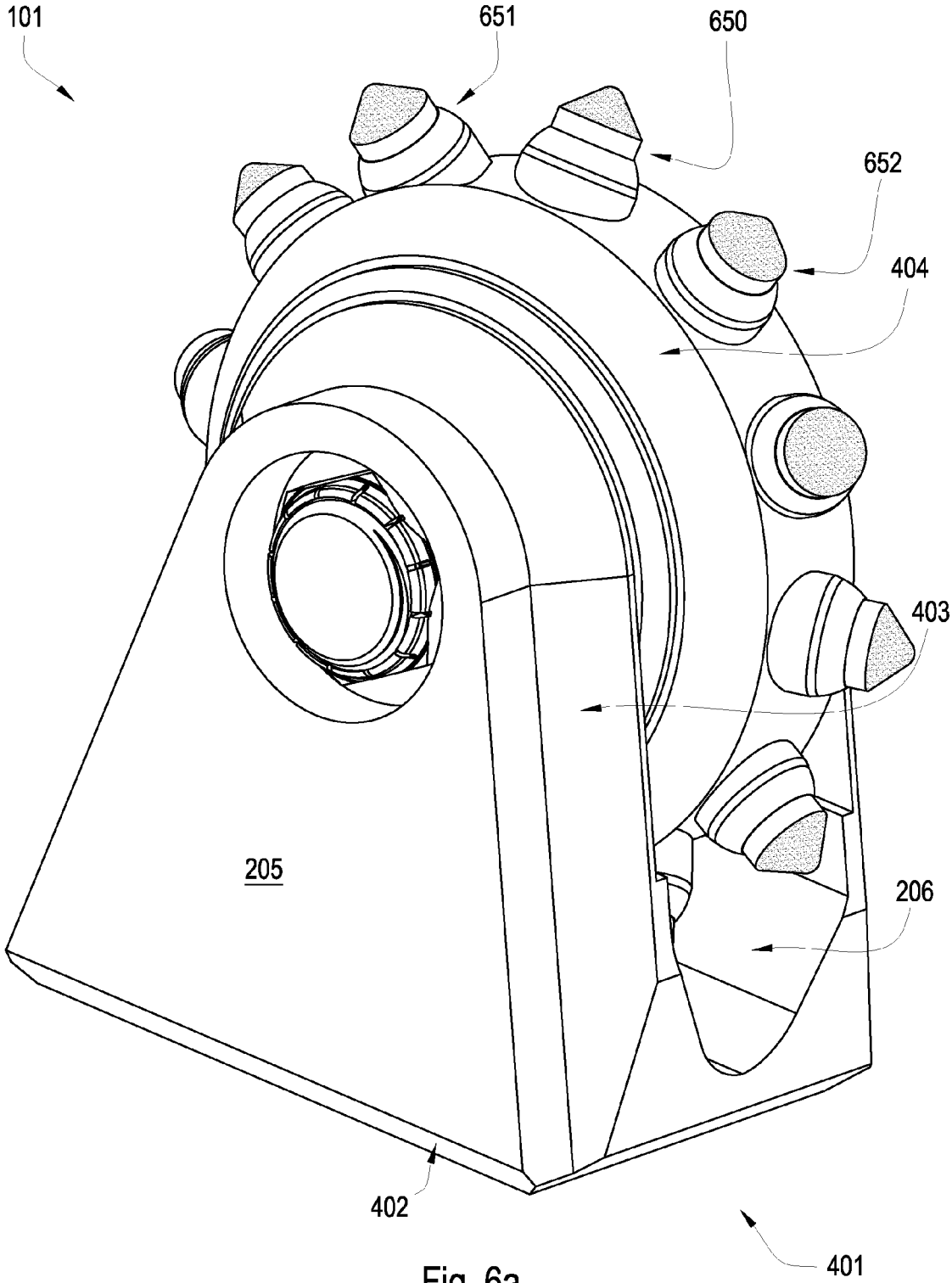

FIG. 6*a* discloses a roller assembly comprising a wheel with a plurality of canted inserts. By canting the inserts, each insert may engage the formation at a different location in the formation, which is believed to increase the rate of degradation of the formation. The inserts may be canted at any angle; in some embodiments, the inserts are canted at 2 to 10 degrees. In the embodiment of FIG. 6*a*, the wheel comprises inserts 651 canted in a first direction, inserts 650 which are canted in another direction, and inserts 652 which are not canted. The inserts may be canted in any direction.

In other embodiments, the housing is skewed which may offset the wheel such that the inserts break the formation in compression and shear. The housing may be skewed at an angle of 2 to 10 degrees. In some embodiment of the present invention, roller assemblies mounted to the chain may be used in combination with picks mounted to the chain.

FIG. 7 is an orthogonal diagram of an embodiment of a trenching machine 103 with dampening elements which are in contact with a block 702 on the trenching machine 103. The block 702 comprises an axle 703 around which the boom 106 pivots. In one embodiment the dampening element may be a hydraulic shock absorber 701 positioned between the block 702 and the trenching machine 103 it may dampen the vibration felt by an operator 704 on the machine. The operator 704 is positioned near a control panel 706 that controls the operations of the trenching machine 103. In some embodiments the block 702 also sits upon a dampening element such as an elastomeric material 705. FIG. 7 also discloses one paddle for every three roller assemblies. In some embodiment, a paddle may be associated with every roller assembly or in other embodiments one paddle may be used for a plurality of roller assemblies. The paddles may have a similar width to the roller assembly or the paddles may comprise a width up to the width of the chain. In other embodiments of the invention, the trenching machine may be controlled remotely, so that an operator positioned on the machine may not be necessary. In such embodiments, the machine may be controlled through Wi-Fi, Bluetooth, radio wave, or a combination thereof.

FIG. 8 is a flowchart of a method of degrading natural or man-made formations. The method comprises a step of providing a plurality of roller assemblies exteriorly mounted to a trenching boom or wheel. The rollers comprising a plurality of pointed inserts radially arranged along its outer diameter. The method further comprises a step of positioning the chain driven assembly adjacent to the formation. The method further comprises a step of degrading the formation with pointed inserts attached to holders by activating the trenching boom or wheel. The method further comprises a step of positioning paddles behind the roller assemblies in order to facilitate the removal of the degraded formation.

Whereas the present invention has been described in particular relation to the drawings attached hereto, it should be understood that other and further modifications apart from those shown or suggested herein, may be made within the scope and spirit of the present invention.

What is claimed is:

1. A trenching machine for degrading natural and man-made formations, comprising;

a plurality of roller assemblies comprising a wheel rotationally supported by a housing which is exteriorly mounted to a trenching boom, and the roller assemblies comprising a plurality of pointed inserts radially arranged along an outer diameter of the wheel;

a tip of the inserts comprises a superhard material selected from the group consisting of cubic boron nitride, diamond, diamond like material, or combinations thereof; and wherein the tip comprises a 0.050 to 0.200 inch apex radius of curvature contained in a plane containing a longitudinal axis.

2. The trenching machine of claim 1, wherein the material is at least 0.100 inches thick.

3. The trenching machine of claim 1, wherein the material of the tip comprise a 3% to 20% by volume concentration of a metal binder.

4. The trenching machine of claim 1, wherein the wheel is made of steel and the inserts are press fit into pockets formed in the wheel.

5. The trenching machine of claim 1, wherein the wheel comprises a lubrication system.

6. The trenching machine of claim 5, wherein the lubrication system comprises a protruding nut.

7. The trenching machine of claim 5, wherein the lubrication system comprises a spring interiorly attached to the opposite end of the protruding nut.

8. The trenching machine of claim 5, wherein the lubrication system comprises a throw-away filter disc.

9. The trenching machine of claim 1, wherein a plurality of paddles are attached to the trenching boom.

10. The trenching machine of claim 9, wherein the paddles are rigidly attached to the trenching boom.

11. The trenching machine of claim 9, wherein the paddles are flexibly attached to the trenching boom.

12. The trenching machine of claim 11, wherein the paddles comprise a flexible attachment with a spring mechanism.

13. The trenching machine of claim 1, wherein the trenching boom is vibrationally insulated from a majority of the trenching machine.

14. A method for degrading natural or man-made formations, comprising the steps of;

providing a plurality of roller assemblies exteriorly mounted to a trenching boom, and the roller assemblies comprising a wheel rotationally supported by a housing, and a plurality of pointed inserts radially arranged along outer diameter of the wheel, the trenching boom also comprising a plurality of paddles proximate the roller assemblies;

positioning the wheel adjacent to the formation; and degrading the formation with pointed inserts attached to holders by activating the trenching boom wherein a tip of the insert comprises a superhard material selected from the group consisting of cubic boron nitride, diamond, diamond like material, or combinations thereof; and wherein the tip comprises a 0.050 to 0.200 inch apex radius of curvature contained in a plane containing a longitudinal axis.

15. The method of claim 14, wherein the inserts comprise a carbide core.

16. The method of claim 15, wherein the carbide cores are press fit into pockets formed in the wheel.

* * * * *